US006506267B1

(12) United States Patent
Fujiyasu et al.

(10) Patent No.: US 6,506,267 B1
(45) Date of Patent: Jan. 14, 2003

(54) PERSONAL ORNAMENT AND SILVER ALLOY FOR PERSONAL ORNAMENT

(75) Inventors: Hiroshi Fujiyasu, Hamamatsu (JP); Shinichiro Ishigaki, Shizuoka (JP); Hiroyasu Nishizawa, Shizuoka (JP)

(73) Assignee: Nippon Germanium Laboratory Co., Ltd., Shizuoka (JP)

( * ) Notice: Subject to any disclaimer, the term of this patent is extended or adjusted under 35 U.S.C. 154(b) by 0 days.

(21) Appl. No.: 09/719,280

(22) PCT Filed: Jun. 24, 1999

(86) PCT No.: PCT/JP99/03387

§ 371 (c)(1),
(2), (4) Date: Dec. 7, 2000

(87) PCT Pub. No.: WO00/26423

PCT Pub. Date: May 11, 2000

(30) Foreign Application Priority Data

Nov. 4, 1998 (JP) ..... 10-313277

(51) Int. Cl.[7] ..... C22C 5/06
(52) U.S. Cl. ..... 148/430; 420/501
(58) Field of Search ..... 420/501; 148/430

(56) References Cited

U.S. PATENT DOCUMENTS 3,669,655 A 6/1972 Cox et al. ..... 75/173 R

FOREIGN PATENT DOCUMENTS

| | | | | |
|---|---|---|---|---|
| JP | 53-43620 | | 4/1978 | |
| JP | 57-114631 | | 7/1982 | |
| JP | 58-104146 | | 6/1983 | |
| JP | 58-48186 | | 10/1983 | |
| JP | 60-258439 | | 12/1985 | |
| JP | 61-6238 | | 1/1986 | |
| JP | 61-000541 A | * | 1/1986 | ..... C22C/5/06 |
| JP | 62-20850 | | 1/1987 | |
| JP | 63-14830 | | 1/1988 | |
| JP | 02-165895 A | * | 6/1990 | ..... C22C/5/06 |
| JP | 6-31755 | | 4/1994 | |
| JP | 7-166269 | | 6/1995 | |
| WO | WO 96/22400 A1 | * | 7/1996 | ..... C22C/5/06 |

OTHER PUBLICATIONS

Patent Abstracts of Japan, Publication No. 53043620 A, Publication date Apr. 19, 1978, 1 page.
Patent Abstracts of Japna, Publication No. 57114631 A, Publication date Jul. 16, 1982, 1 page.
Patent Abstracts of Japan, Publication No. 58104146 A, Publication date Jun. 21, 1983, 1 page.
Patent Abstracts of Japan, Publication No. 60258439 A, Publication date Dec. 20, 1985, 1 page.
Patent Abstracts of Japan, Publication No. 61006238 A, Publication date Jan. 11, 1986, 1 page.
Patent Abstracts of Japan, Publication No. 07166269 A, Publication date Jun. 27, 1995, 1 page.
Patent Abstracts of Japan, Publication No. 62020850 A, Publication date Jan. 29, 1987, 1 page.
Patent Abstracts of Japan, Publication No. 63014830 A, Publication date Jan. 22, 1988, 1 page.

* cited by examiner

*Primary Examiner*—Roy King
*Assistant Examiner*—Harry D. Wilkins, III
(74) *Attorney, Agent, or Firm*—Rosenthal & Osha L.L.P.

(57) ABSTRACT

The accessory of the present invention comprises 1% to 9% by weight of germanium, 2% to 20% of indium in terms of weight ratio with respect to germanium, and the rest constituted by silver. It can provide an accessory realizing a metallic luster similar to the brightness of platinum and the health-enhancing and curing effect caused by the far-infrared effect at the same time.

10 Claims, 2 Drawing Sheets

PERSONAL ORNAMENT AND SILVER ALLOY FOR PERSONAL ORNAMENT

TECHNICAL FIELD

The present invention relates to an accessory mainly composed of silver, and a silver alloy for the accessory.

BACKGROUND ART

As silver alloys mainly composed of silver, those for electric contacts, those for accessories, and the like have conventionally been known; whereas publications such as Japanese Patent Application Laid-Open No. SHO 53-43620, Japanese Patent Application Laid-Open No. SHO 57-114631, Japanese Patent Application Laid-Open No. SHO 58-104146, Japanese Patent Application Laid-Open No. SHO 60-258439, Japanese Patent Application Laid-Open No. SHO 61-6238, Japanese Patent Application Laid-Open No. SHO 62-20850, Japanese Patent Application Laid-Open No. SHO 63-14830, and Japanese Patent Application Laid-Open No. HEI 7-166269, for example, have been known to disclose these silver alloys.

First, Japanese Patent Application Laid-Open No. SHO 53-43620 discloses a silver alloy for use in wristwatch belts and the like, which comprises silver as a base material and contains palladium, tin, zinc, aluminum, and the like in addition to germanium and indium.

Japanese Patent Application Laid-Open No. SHO 57-114631 discloses a silver alloy for dental use, which comprises silver as a base material and contains palladium, copper, and the like in addition to germanium or indium.

Japanese Patent Application Laid-Open No. SHO 58-104146 discloses a silver alloy for use in sliding contacts of commutators, which comprises silver as a base material and contains indium, or comprises silver as a base material and contains bismuth and the like in addition to indium.

Japanese Patent Application Laid-Open No. SHO 60-258439 discloses a silver alloy for dental use, which comprises silver as a base material and contains palladium, copper, zinc, and the like in addition to germanium and indium.

Japanese Patent Application Laid-Open No. SHO 61-6238 discloses a silver alloy for use in sliding contacts of commutators, which comprises silver as a base material and contains cadmium and the like in addition to indium and germanium.

Japanese Patent Application Laid-Open No. SHO 62-20850 discloses a silver alloy for use in art and craft products, accessories, and the like, which comprises silver as a base material and contains zinc, boron, and the like in addition to germanium. It also discloses one which comprises silver as a base material and contains tin, zinc, and the like in addition to indium.

Japanese Patent Application Laid-Open No. SHO 63-14830 discloses a silver alloy for use in wristwatches, rings, pendants, tableware, and the like, which comprises silver as a base material and contains platinum, tin, zinc, and the like in addition to germanium and indium.

Japanese Patent Application Laid-Open No. HEI 7-166269 discloses a silver alloy for use in sliding contacts of commutators, which comprises silver as a base material and contains copper, palladium, bismuth, and the like in addition to indium and germanium.

DISCLOSURE OF THE INVENTION

Each of the above-mentioned conventional techniques comprises silver as a base material, contains germanium or indium, and has a suitability for dental use, electric contacts, or common accessories.

Apart from the silver alloys for dental use and electric contacts, those for common accessories disclosed in Japanese Patent Application Laid-Open No. SHO 53-43620, No. SHO 62-20850, and No. SHO 63-14830 have problems as follows. Namely, the silver alloy of Japanese Patent Application Laid-Open No. SHO 53-43620 is likely to be oxidized since it contains aluminum, the silver alloy of Japanese Patent Application Laid-Open No. SHO 62-20850 is materially unstable since boron is used therein, and the silver alloy of Japanese Patent Application Laid-Open No. SHO 63-14830 is expensive since platinum is used therein.

Meanwhile, known as accessories are not only those such as rings and pierced earrings mainly aimed at aesthetically decorating bodies and those such as wristwatch belts mainly aimed at attaching an article (the main part of a watch) having a specific function to a body, but also health-oriented type accessories secondarily or mainly aimed at the improvement of health and predetermined curing/healing effects.

However, such conventional accessories in which health, cure, and the like are taken into consideration contain germanium as their main ingredient and are different from those mentioned above that are aimed at decoration. For example, the one described in Japanese Patent Publication No. SHO 58-48186 is configured such that a solid piece of N-type, intrinsic, or P-type germanium comes into contact with a skin with the aid of a member such as tape, and is assumed to be capable of killing pains and sedating inflammations due an electric action.

Though various studies have been made in addition to the above-mentioned conventional techniques, no silver alloys have yet been provided which are suitable for accessories expected to be effective in the improvement of health and the like while being used in contact with a skin. Namely, no silver alloys have been provided which takes account of the far-infrared effect inherent in germanium, i.e., the fact that germanium can exhibit a health-improving and curing effect for curing/healing stiff shoulders and the like.

Therefore, the inventor has repeated diligent studies and, as a result, has invented a novel silver alloy for accessories which is suitable for a constituent material for an accessory having both of a decorating function and a health-improving or curing/healing function.

Considering that a silver alloy suitable for a constituent material for an accessory having both of a decorating function and a health-improving or curing/healing function needs to satisfy the following first to fifth demands, the inventor has repeated various studies.

The first of demands is that it has a brightness and luster sufficient as a material of an accessory attached to a body; the second is that it is excellent in processibility as an accessory, i.e., it has appropriate degrees of hardness, ductility, and malleability; the third is that it is excellent in resistance to oxidation and other resistances to corrosion; the fourth is that it is a safe material to be used in contact with a body without needing excessively expensive components; and the fifth is that it fully exhibits the far-infrared effect inherent in germanium, i.e., the health-improving and curing effect for curing/healing stiff shoulders and the like.

According to the inventor's studies, the silver alloy for accessories satisfying such demands comprises 1% to 9% by weight of germanium, 2% to 20% of indium in terms of weight ratio with respect to germanium, and the rest constituted by silver.

First, the silver alloy for accessories in accordance with the present invention can realize a brightness and luster suitable for an accessory attached to a body since it contains an appropriate amount of germanium. Namely, though it will have a silver-gray tint if germanium is less than 1% by weight, a brightness and luster similar to those of platinum can be obtained if the germanium content is 1% by weight or greater.

Second, it can improve the processibility as an accessory since it contains an appropriate amount of indium with respect to germanium. Namely, though an alloy of silver and germanium is likely to be brittle even if the amount of germanium is small, appropriate hardness, ductility, and malleability can be attained until the germanium content reaches approximately 9% by weight if an appropriate amount (2% to 20% in terms of weight ratio with respect to germanium) of indium is added thereto.

Third, while an alloy of silver and germanium is superior to pure silver in resistances to corrosion such as resistance to sulfurization, the resistance to oxidization and other resistances to corrosion can further be improved if indium is further added to this alloy. For example, while an accessory is exposed to sweat containing moisture, salts, and the like when used in contact with a body for a long period of time, it is less likely to yield corrosion and discoloration. If aluminum is added thereto, by contrast, it will be disadvantageous in that the alloy is more likely to be oxidized.

Fourth, each of silver, germanium, and indium is a safe material to be used in contact with a skin, whereas cadmium, for example, cannot be used in accessories. Though platinum or the like has a high security, the cost tends to increase when it is used.

Fifth, it can fully exhibit the far-infrared effect inherent in germanium, i.e., the health-improving and curing effect for curing/healing stiff shoulders and the like. The far-infrared effect of germanium is effectively exhibited in particular when microcrystals of germanium are formed in the base material of silver. This is because of the fact that microcrystals of germanium have a semiconductor-like property since they are crystals in spite of their minuteness. According to inventor's experiments, only a small amount of microcrystals are formed when germanium is less than 1% by weight, whereas the constituting ratio of microcrystals decreases if the germanium amount is 9% by weight or greater on the contrary. Therefore, it is desirable that germanium be contained by at least 1% by weight but less than 9% by weight.

While the far-infrared effect of germanium is quite remarkably exhibited when germanium is a P-type semiconductor as compared with the case where it is an N-type or intrinsic semiconductor, indium is a III-group element and becomes an acceptor when added to a semiconductor, thus yielding P type. While silver acts as a donor with respect to germanium, thus yielding N type, on the other hand, its solubility is not greater than ⅓ that of indium. Therefore, if indium is used as a doping element, then P type is eventually realized. While boron and zinc may be considered as P-type impurities, boron is unfavorable in that it has such a small atomic radius that it is easy to get into and out from between atoms and is unstable. Zinc is hard to realize P type since its solubility is low.

The accessory of the present invention is characterized in that an outer surface thereof coming into contact with a skin while being worn on a body is constituted by a silver alloy for accessories, which will be explained later. While examples of accessories coming into contact with a skin in a state worn on a body include necklace, bracelet, wristband, ring, and wristwatch, they may be totally formed from the silver alloy for accessories of the present invention, or the plated layer on the surface thereof may be formed from the silver alloy for accessories of the present invention.

Preferably, the silver alloy for accessories in accordance with the present invention may contain at least 1.4% by weight a of germanium. As a consequence, while it is mainly composed of silver which is inexpensive as a rare metal, a brightness similar to that of platinum is favorably realized, and the ratio of microcrystallization of germanium can be made higher.

The silver alloy for accessories in accordance with the present invention may contain less than 5% by weight of germanium. As a consequence, the amount of germanium remaining in an atomic state without being microcrystallized can be made smaller.

Preferably, the silver alloy for accessories in accordance with the present invention may be such that the weight ratio of indium with respect to germanium is at least 5%. As a consequence, the far-infrared effect caused by P-type germanium can further be improved while further improving its processibility.

Preferably, the silver alloy for accessories in accordance with the present invention may be such that the weight ratio of indium with respect to germanium is less than 13%. As a consequence, the far-infrared effect caused by P-type germanium can further be improved while hardness can be secured when used in an accessory.

BEST MODES FOR CARRYING OUT THE INVENTION

Figure 1A:
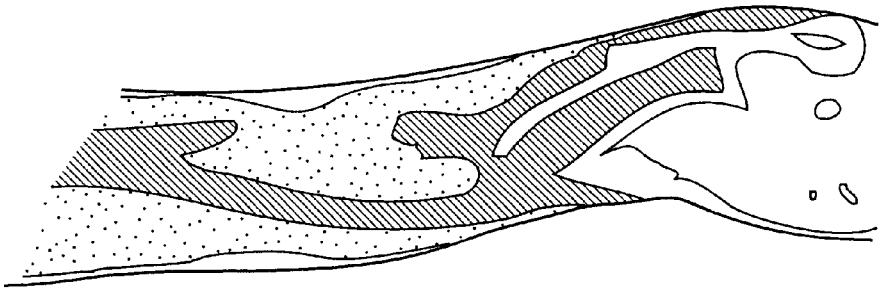
FIG. 1A is a diagram transcribing a photograph of a man's arm taken by a thermograph.

The present invention relates to an accessory having both of a decorating function and a health-oriented function, and uses silver, which is a kind of rare metal, as its base material. While both of the decorating function and health-oriented function are improved since an appropriate amount of germanium is added to silver so as to form an alloy, the improvement in processibility for ameliorating the decorating function and the enhancement in health-oriented function are realized at the same time since an appropriate amount of indium is added thereto.

While a number of germanium microcrystals (semiconductors) are formed when silver and germanium form an alloy, silver in the base material is likely to dissolve therein, thus functioning as a donor, thereby forming N type. Therefore, it is necessary to add thereto an element which can function as an acceptor, so as to cancel the function of donor (silver), thereby causing the microcrystals of germanium to become P type.

While examples of elements functioning as an acceptor include indium, boron, zinc, and aluminum, boron is unfavorable in that it gets into and out from between atoms in microcrystals of germanium since its atomic radius is too small. Since zinc has a low solubility, it is hard to cancel the function of donor (silver), so as to cause the microcrystals of germanium to become P type. Aluminum is hard to use since it is likely to be oxidized.

By contrast, indium is favorable as a doping element for forming an acceptor since it has a relatively large atomic radius, a solubility which is three times that of silver, and is hard to be oxidized. Further, the malleability and ductility lowered upon forming an alloy with germanium are recovered when indium is added thereto, whereby decorative processing becomes easier, and the hardness appropriate for an accessory is also maintained.

Tin, cadmium, palladium, bismuth, and the like which are often added to silver alloys are not favorable due to the following reasons. In microcrystals of germanium, tin forms a donor with an acceptor in germanium microcrystals, thereby being unstable. Cadmium is not only harmful, but also forms a donor and a deep impurity level in germanium microcrystals, thereby being incapable of yielding P type. Bismuth also forms a donor and a deep impurity level in microcrystals of germanium, thus being unusable. Palladium forms a deep impurity level in microcrystals of germanium, thereby lowering the P-type effect caused by indium.

In the following, results of studies based on inventor's experiments will be explained.

The far-infrared effect of germanium yielding the health-improving and curing effect for curing/healing. stiff shoulders and the like is exhibited when microcrystals of germanium are formed in the base material of silver. This is because of the fact that microcrystals of germanium have a semiconductor-like property since they are crystals in spite of their minuteness. Therefore, according to inventor's experiments and hypotheses, the far-infrared effect of germanium microcrystals is exhibited when germanium is at least 1% by weight but less than 9% by weight. In addition, while the far-infrared effect of germanium microcrystals is remarkable in the case of P type, indium is a III-group element and has a solubility higher than that of silver, so that it yields P type in germanium microcrystals when added by 2% to 20% in terms of weight ratio with respect to germanium.

First Study: Making of Pellet as Prototype and Attachment Test

Hence, the inventor cast a silver alloy having the following component ratio, made a pellet as a prototype therefrom, and tested its far-infrared effect.

Component ratio was such that silver: germanium: indium=95:4.75:0.25. The size of pellet was 20 mm×20 mm.

Figure 1B:
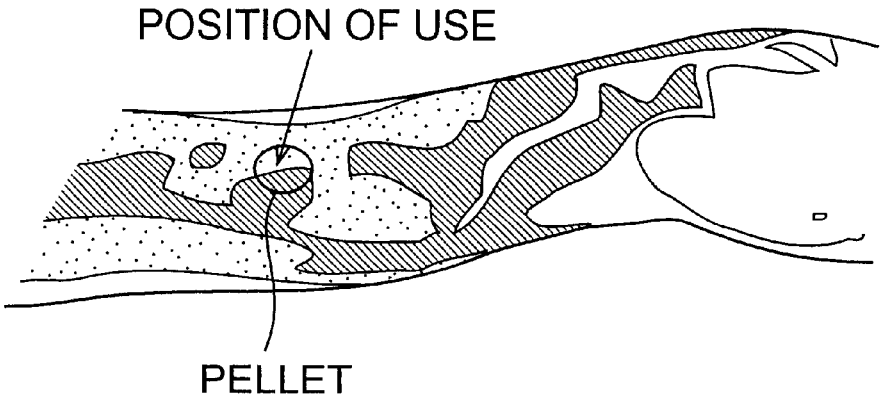
FIG. 1B is a diagram transcribing a photograph taken by a thermograph when a pellet made of a silver alloy in accordance with the present invention as a prototype is attached to the man's arm shown in FIG. 1A.

Under the environment of room temperature (22° C.), the pellet was mounted on a 61-year-old male's left arm for 30 seconds, and the arm was photographed with a thermography (having a temperature resolution of 1° C., manufactured by JEOL) at the same time when the pellet was removed. As can be seen when compared with the photograph taken immediately before the pellet was mounted (FIG. 1A, which is a diagram transcribing this photograph), the temperature of skin was found to increase at the position where the pellet was placed (see FIG. 1B).

Second Study: Making of Necklace as Prototype and Wearing Test

Next, the inventor cast a silver alloy having components identical to those of the above-mentioned pellet, and made a necklace as a prototype. First, thus cast ingot was extended like a tape, which was then bundled and solidified, so as to form a necklace. Here, the silver alloy was tough, sufficiently rich in malleability and ductility and excellent in processibility.

Figure 2A:
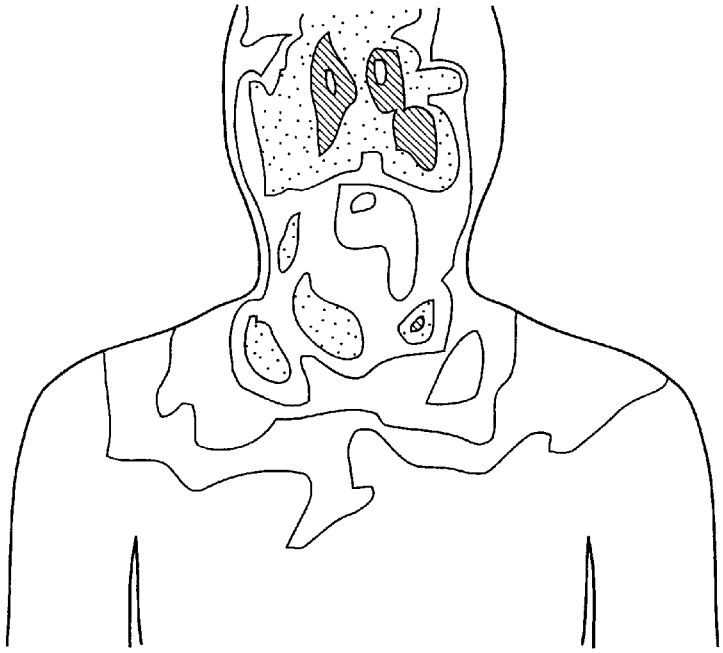
FIG. 2A is a diagram transcribing a photograph of a man's neck taken by a thermograph.
Figure 2B:
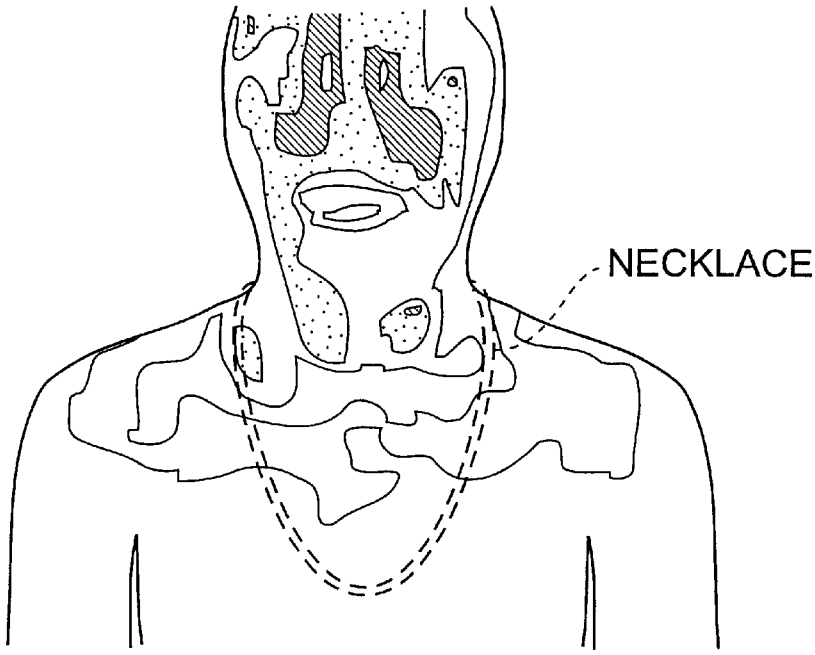
FIG. 2B is a diagram transcribing a photograph taken by a thermograph when a necklace made of a silver alloy in accordance with the present invention as a prototype is worn about the man's neck shown in FIG. 2A.

Using this necklace, the far-infrared effect was tested. Under the environment of room temperature (22° C.), the necklace was hung about a33-year-old male's neck and left for 5 minutes, and then a photograph was taken with a thermography (having a temperature resolution of 1° C., manufactured by JEOL) from the front side. As can be seen when compared with the photograph taken immediately before the necklace was worn (FIG. 2A, which is a diagram transcribing this photograph), the temperature was found to increase in the vicinity of necklace and on the face (see FIG. 2B).

Such a far-infrared effect will now be explained. The action of electromagnetic waves such as far-infrared rays upon organisms includes an ionizing action and a nonionizing action, whereas a thermal action and a nonthermal action are known as the nonionizing action. The ionizing action is mainly caused by shorter-wavelength electromagnetic waves (e.g., radiation and ultraviolet rays) having a higher energy, whereas longer-wavelength electromagnetic waves (e.g., infrared rays) yield the thermal and nonthermal actions as the nonionizing action.

When an organism is irradiated with infrared rays, temperature rises within the organism due to the absorbed energy, there by exhibiting a so-called heating effect. In the case of far-infrared rays having a wavelength of about 100 microns, the irradiated weak electromagnetic wave directly acts on the organism in addition to the above-mentioned thermal effect, thereby exhibiting a so-called nonthermal effect.

In this connection, Frohlich has proposed the following model since 1960s. Namely, it has been elucidated that, while a number of coherent vibration modes exist in an organism, vibrations concentrate on specific modes when energy is supplied, so that excitation with a macroscopic order can occur, and a long-distance interaction can occur between modes having the same frequency. Also, according to this model, it has been suggested that there is a possibility of a nonthermal action being applied to an organism in a wavelength region ranging from far-infrared rays to microwaves.

For example, while mitochondria, which is an important organism-constituting material, synthesizes an electron transport system and, in conjugation therewith, ATP from ADP, the above-mentioned nonthermal action is expected to be involved in the process of generating ATP. In this connection, Tadashi Fuse, et al., in *Proceedings of the Infrared Society of Japan*, No. 12 (1997) have experimentally verified and studied a nonthermal action of far-infrared rays in a 100-micron band upon mitochondria which is an organelle within a cell.

On the other hand, it has been known that germanium is an indirect transition type semiconductor, whose band gap energy is 0.67 eV (corresponding to near-infrared rays), including two kinds of holes, i.e., heavy and light holes, and emits far-infrared rays having a wavelength in the order of 100 microns in relation to these holes when cooled to a liquid helium temperature while an electric field and a magnetic field are applied thereto. For example, Susumu Komiyama has made a semiconductor laser as a prototype using P-type germanium containing an impurity of a III-group atom and verified a far-infrared laser oscillation having a wavelength of 80 to 120 microns while cooling it with liquid helium (*Solid State Physics*, Vol. 31, No. 4 (1996)).

Here, the radiation mechanism of far-infrared rays presumed by the author (Komiyama) of the above-mentioned thesis will be explained in brief. While a large number of holes are degenerated to the gamma point (the apex of band) in the state where P-type germanium (indirect transition type semiconductor) is at a very low temperature, so-called cyclotron movement begins when electric and magnetic fields orthogonal to each other are applied. Here, the heavy hole attains a kinetic energy identical to that of an optical phonon in a short period of time since its effective mass is greater than that of the light hole by about eight times. Then, while the holes immediately release the optical phonon and return to the heavy hole band again, a part of the holes are scattered to the light hole band. Thus, light holes are accumulated, whereby a population inversion occurs with respect to the heavy holes. These light holes attain a kinetic energy due to the electric field, and directly optically transits to the heavy hole band if the kinetic energy reaches a predetermined energy level, thereby emitting far-infrared rays in the 100-micron wavelength band.

Taking account of these two verified facts, the inventor has presumed that, if a silver alloy containing microcrystals of P-type germanium is in contact with a human body, P-type germanium having an absolute temperature of about 300 degrees would release far-infrared rays having a wavelength of about 100 microns, which may cause a nonthermal action together with a thermal action upon the human body.

The radiation mechanism presumed by the inventor will now be explained in brief. While a large amount of holes are degenerated to the gamma point (the apex of band) in the state where microcrystals of P-type germanium exposed to the surface of silver alloy are at a very low temperature, they attain a thermal energy when temperature rises, whereby their energy distribution widens, and fluctuations occur. Namely, since the holes have a Fermi level located near the valence band, they have an energy of 25 meV, whereby they are easily excited to a level of 2.5 meV corresponding to the far-infrared rays in the 100-micron wavelength band. Thus, the heavy holes are easily thermally excited from their band to a light hole band and then release far-infrared rays, thereby returning to the original heavy holeband. Namely, they would emit far-infrared rays having a wavelength in the 100-micron band.

Here, the above-mentioned explanation is merely a hypothesis, and the validity of this hypothesis would not affect the characteristics and ranges of the present invention, i.e., the characteristic feature that it comprises 1% to 9% by weight of germanium, 2% to 20% of indium in terms of weight ratio with respect to germanium, and the rest constituted by silver.

Third Study: Elution of Germanium

The amount of elution of germanium was measured in three kinds of samples A1, A2, and A3. The contents (% by weight) of silver, germanium, and indium in the cast individual samples (alloys) are as follows:

Sample A1: Ag:Ge:In=90:10:0

Sample A2: Ag:Ge:In=95:4.94:0.06

Sample A3: Ag:Ge:In=95:4.6:0.4

These samples were immersed in 100 ml of 0.1% aqueous sodium sulfide solution, and the concentration of eluted germanium was measured with ICP. The concentrations after the lapse of 24 hours were:

Sample A2: 6.3 ppm

Sample A2: 4.6 ppm

Sample A3: 0.03 ppm

As the amount of addition of indium increased, the amount of elution of germanium decreased.

Fourth Study: Resistance to Corrosion (First Time)

Using five kinds of samples B1 to B5, the resistance to corrosion was observed. The contents (% by weight) of silver, germanium, and indium in the cast individual samples (alloys) are as follows:

Sample B1: Ag:Ge:In=99:0.92:0.08

Sample B2: Ag:Ge:In=98:1.84:0.16

Sample B3: Ag:Ge:In=97:2.76:0.24

Sample B4: Ag:Ge:In=95:4.60:0.40

Sample B5: Ag:Ge:In=90:9.20:0.80

These samples were immersed in 100 ml of 0.1% aqueous sodium sulfide solution, and changes in their surface states were observed with naked eye.

A. After several minutes: A part of the surface in each of samples B1 to B3 became light brown, whereby it was seen that sulfurization began. There were no changes in samples B4 and B5.

B. After 12 hours: Samples B1 to B3 turned blue, where as samples B4 and B5 became light brown. When their densities in color were compared with each other, sample B1 was the densest, and the color became lighter as the sample number increased.

C. After 24 hours: Samples B1 to B3 became dark blue, sample B4 became bluish brown, and sample B5 became brown. When their densities in color were compared with each other, sample $B_1$ was the densest, and the color became lighter as the sample number increased.

It was seen that sulfurization was harder to attain as germanium increased within the range where the germanium content was not greater than 9.2% by weight.

Fifth Study: Resistance to Corrosion (Second Time)

Using the above-mentioned five kinds of samples B1 to B5, the resistance to corrosion was observed again. In this case, the surface was ground to a mirror surface, immersed in the aqueous sodium sulfide solution, and observed with naked eye. As a result, the surface was not discolored in particular in each of the samples, and was kept in the mirror surface even after the lapse of 24 hours.

Sixth Study: Elution of Germanium (First Time)

In parallel with the observation of resistance to corrosion using the above-mentioned five kinds of samples B1 to B5, the amount of elution of germanium was measured with ICP. The amount of elution (ppm) was as follows. Here, "ND" indicates that none was detected.

TABLE 1

| | Results of Measurement of Amount of Elution (First Time) | | | |
|---|---|---|---|---|
| SAMPLE | AFTER 1 hr | AFTER 6 hr | AFTER 12 hr | AFTER 24 hr |
| B1 | 0.03 | 0.12 | 0.16 | 0.24 |
| B2 | ND | ND | ND | 0.02 |
| B3 | ND | ND | ND | 0.06 |
| B4 | ND | ND | 0.01 | 0.03 |
| B5 | ND | 0.06 | 0.07 | 0.17 |

As can be seen, it was found that the amount of elution was greater in samples B1 and B5, and was smaller in samples B2 to B4.

Seventh Study: Elution of Germanium (Second Time)

For the sake of accuracy, the surface of each of samples B1 to B5 used for the first measurement was ground, and then similar measurement was repeated. Table 2 shows the results.

TABLE 2

| SAMPLE | Results of Measurement of Amount of Elution (Second Time) AFTER 1 hr | AFTER 6 hr | AFTER 12 hr | AFTER 24 hr |
|---|---|---|---|---|
| B1 | ND | ND | ND | 0.02 |
| B2 | ND | ND | ND | ND |
| B3 | ND | ND | ND | ND |
| B4 | ND | ND | ND | ND |
| B5 | 0.08 | 0.09 | 0.06 | 0.10 |

From the results of elution tests shown in Tables 1 and 2, the inventor have made a hypothesis as follows. Namely, while a part of germanium atoms are dissolved in a so-called atomic state as being separated into individual atoms in silver in a silver-germanium alloy in which silver is used as a base material, the rest of germanium atoms might be dispersed as microcrystals into silver. The constituting ratio between those in the atomic state and microcrystal state seems to vary depending on the germanium content under a condition where an appropriate amount of indium is added thereto.

Namely, it is assumed that, though germanium is dissolved in silver without being able to form microcrystals when it exists by only a very small amount (less than 1% by weight), microcrystals are formed while lowering the constituting ratio of atomic state as germanium increases (1% to 9% by weight), and the ratio by which germanium dissolves in the atomic state without being able to form microcrystals increases if germanium further increases (9% by weight or greater).

If the silver alloy is immersed in sodium sulfide, then germanium is exposed to the aqueous sodium sulfide solution as silver corrodes. However, while germanium in the atomic state easily dissolves into the aqueous solution, germanium in the microcrystal state would not dissolve. The fact that the amount of elution of germanium is greater in samples B1 and B5 and smaller (or not detected) in samples B2 to B4 can be considered to indicate the validity of the above-mentioned hypothesis.

Industrial Applicability

The present invention can realize a silver alloy having both of a decorating function and a health-oriented function, and an accessory made from this alloy. In particular, the accessory of the present invention can realize a metallic luster similar to the brightness-of platinum and the health-enhancing and curing effect caused by the far-infrared effect at the same time.

What is claimed is:

1. An accessory comprising an outside exposed portion, at least a part of said exposed portion disposed at a position where the accessory directly contacts with a human skin and consisting essentially of:

1% to 9% by weight of germanium;

indium in amount ranging from 2% to 20% by weight of the germanium; and remaining balance of said exposed portion being silver.

2. The accessory according to claim 1, wherein weight ratio of germanium is 4%–9% of said exposed portion.

3. The accessory according to claim 1, wherein weight ratio of germanium is 1%–5% of said exposed portion.

4. The accessory according to claim 1, wherein weight ratio of indium with respect to germanium is 5%–20%.

5. The accessory according to claim 1, wherein weight ratio of indium with respect to germanium is 2%–13%.

6. A silver alloy for an accessory, said silver alloy consisting essentially of:

1% to 9% by weight of germanium;

indium in amount ranging from 2% to 20% by weight of germanium; and remaining balance being silver.

7. The silver alloy according to claim 6, wherein weight ratio of germanium is 4%–9%.

8. The silver alloy according to claim 6, wherein weight of germanium is 1%–5%.

9. The silver alloy according to claim 6, wherein weight ratio of indium with respect to germanium is 5%–20%.

10. The silver alloy according to claim 6, wherein weight ratio of indium with respect to germanium is 2%–13%.

* * * * *

UNITED STATES PATENT AND TRADEMARK OFFICE

CERTIFICATE OF CORRECTION

PATENT NO. : 6,506,267 B1 
DATED : January 14, 2003
INVENTOR(S) : Hiroshi Fujiyasu et al.

It is certified that error appears in the above-identified patent and that said Letters Patent is hereby corrected as shown below:

Title page,
Item [54], the title should be changed from "PERSONAL ORNAMENT AND SILVER ALLOY FOR PERSONAL ORNAMENT" to -- ACCESSORY AND SILVER ALLOY FOR ACCESSORY --.

Signed and Sealed this

Thirteenth Day of May, 2003

JAMES E. ROGAN
*Director of the United States Patent and Trademark Office*